US010507146B1

(12) United States Patent
Alhajery et al.

(10) Patent No.: US 10,507,146 B1
(45) Date of Patent: Dec. 17, 2019

(54) SITTING TO STANDING LIFT CHAIR

(71) Applicants: Aliah M. Z. F. M. Alhajery, Mishref (KW); Alaa K H. M. Abdullah, Mishref (KW); Hasna F. F. F. S. Alajmi, Mishref (KW); Munirah S. E. A. A. Alburaidi, Mishref (KW)

(72) Inventors: Aliah M. Z. F. M. Alhajery, Mishref (KW); Alaa K H. M. Abdullah, Mishref (KW); Hasna F. F. F. S. Alajmi, Mishref (KW); Munirah S. E. A. A. Alburaidi, Mishref (KW)

( * ) Notice: Subject to any disclaimer, the term of this patent is extended or adjusted under 35 U.S.C. 154(b) by 0 days.

(21) Appl. No.: 16/575,263

(22) Filed: Sep. 18, 2019

(51) Int. Cl.
*A61G 5/14* (2006.01)
*A61G 5/12* (2006.01)

(52) U.S. Cl.
CPC ..... *A61G 5/14* (2013.01); *A61G 5/128* (2016.11)

(58) Field of Classification Search
CPC ..... A61G 5/14; A61G 5/128; A47C 17/138
See application file for complete search history.

(56) References Cited

U.S. PATENT DOCUMENTS

| | | | | |
|---|---|---|---|---|
| 3,640,566 | A | 2/1972 | Hodge | |
| 4,569,556 | A | 2/1986 | Pillot | |
| 4,623,194 | A | 11/1986 | Pillot | |
| 4,949,408 | A | 8/1990 | Trkla | |
| 5,042,487 | A * | 8/1991 | Marquardt | A61B 6/0457 378/17 |
| 5,108,202 | A | 4/1992 | Smith | |
| 6,533,304 | B2 | 3/2003 | Lizama-Troncoso et al. | |
| 6,540,250 | B1 * | 4/2003 | Peterson | A61G 5/042 280/304.1 |
| 8,128,120 | B2 * | 3/2012 | Porcheron | A61G 5/006 180/65.1 |
| 9,301,895 | B2 * | 4/2016 | Hough | A61G 5/14 |
| 9,375,372 | B2 | 6/2016 | Hunziker | |
| 9,782,005 | B2 * | 10/2017 | Paul | A47C 1/0342 |
| 2005/0046129 | A1 * | 3/2005 | Antonishak | A61G 5/043 280/47.4 |
| 2011/0260513 | A1 * | 10/2011 | Chen | A47C 1/0342 297/344.11 |
| 2018/0133077 | A1 * | 5/2018 | Chen | A47C 1/0355 |
| 2018/0271727 | A1 * | 9/2018 | Lee | A61G 5/14 |

FOREIGN PATENT DOCUMENTS

DE 19816879 A1 10/1999

* cited by examiner

*Primary Examiner* — Philip F Gabler
(74) *Attorney, Agent, or Firm* — Richard C. Litman; Nath, Goldberg & Meyer

(57) ABSTRACT

The sitting to standing lift chair is useful for the elderly and physically impaired when transitioning from a sitting position to a standing position, or vice versa. The chair includes a seat bottom, a seat back rotatably attached to the rear edge of the seat bottom, armrests attached to side edges of the seat back, hand grips on the armrests, a headrest and a footrest rotatably attached to the front edge of the seat bottom. A base and a bottom elevated platform support the other chair components and provide an adjustable height for the chair. The seat bottom is supported on the bottom elevated platform using a sitting to standing mechanism, which provides for raising and lowering the seat bottom while keeping the seat back vertical. Three control switches operate motors for controlling the height of the chair, the position of the footrest and the sitting to standing mechanism.

20 Claims, 9 Drawing Sheets

SITTING TO STANDING LIFT CHAIR

BACKGROUND

1. Field

The present invention relates to chairs and lifts, and in particular, to a sitting to standing lift chair for assisting the elderly, the disabled, and the overweight with rising from a sitting position to a standing position.

2. Description of the Related Art

Many people, especially the elderly, injured, and overweight, have difficulties standing by themselves and require assistance to help lift them out of their sitting position. Human assistance can be painful, costly, and sometimes unavailable. Nurses and those working in the medical field sometimes have to lift patients up to stand. This might be a problem, depending on the limitations of the nurse's physical strength. Patients who have spinal problems sometimes do not keep correct posture when rising from a sitting position, as they tend to lean forward, causing an increase in the amount of stress acting on the spine. While some sitting to standing assistance devices are known, such devices are predominately manual, requiring the assistance of a second person. Motorized sitting to standing assistance devices are large and often combined with wheel chairs, thereby requiring additional storage space when not in use. Many such devices do not assist in helping the user to maintain the correct posture, or do not have a height control function to adjust for users of different heights. Thus, a sitting to standing lift chair solving the aforementioned problems is desired.

SUMMARY

The sitting to standing lift chair is useful for the elderly, overweight, and the physically impaired when transitioning from a sitting position to a standing position, or vice versa. The chair includes a seat bottom, a seat back rotatably attached to the rear edge of the seat bottom, armrests attached to side edges of the seat back, hand grips on the armrests, a headrest, and a footrest rotatably attached to the front edge of the seat bottom. A base and a bottom elevated platform support the other chair components and provide an adjustable height for the chair. The seat bottom is supported on the bottom elevated platform using a sitting to standing mechanism, which provides the motion of raising and lowering the seat bottom while keeping the seat back vertical. Control switches mounted on one of the armrests operate motors for controlling the height of the chair, the position of the footrest, and the sitting to standing mechanism. The sitting to standing lift chair is relatively inexpensive, does not take up a lot of space, is easy to operate by a single person (the user or patient), and provides good support of knees, hips, and upper body throughout its operational range. The chair provides both lifting and rotation of the user in order to reduce the effort and stress on the legs and joints of the person using the chair, and the seat back of the chair is attached to the seat bottom in a manner that allows correct posture of the back and hips.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
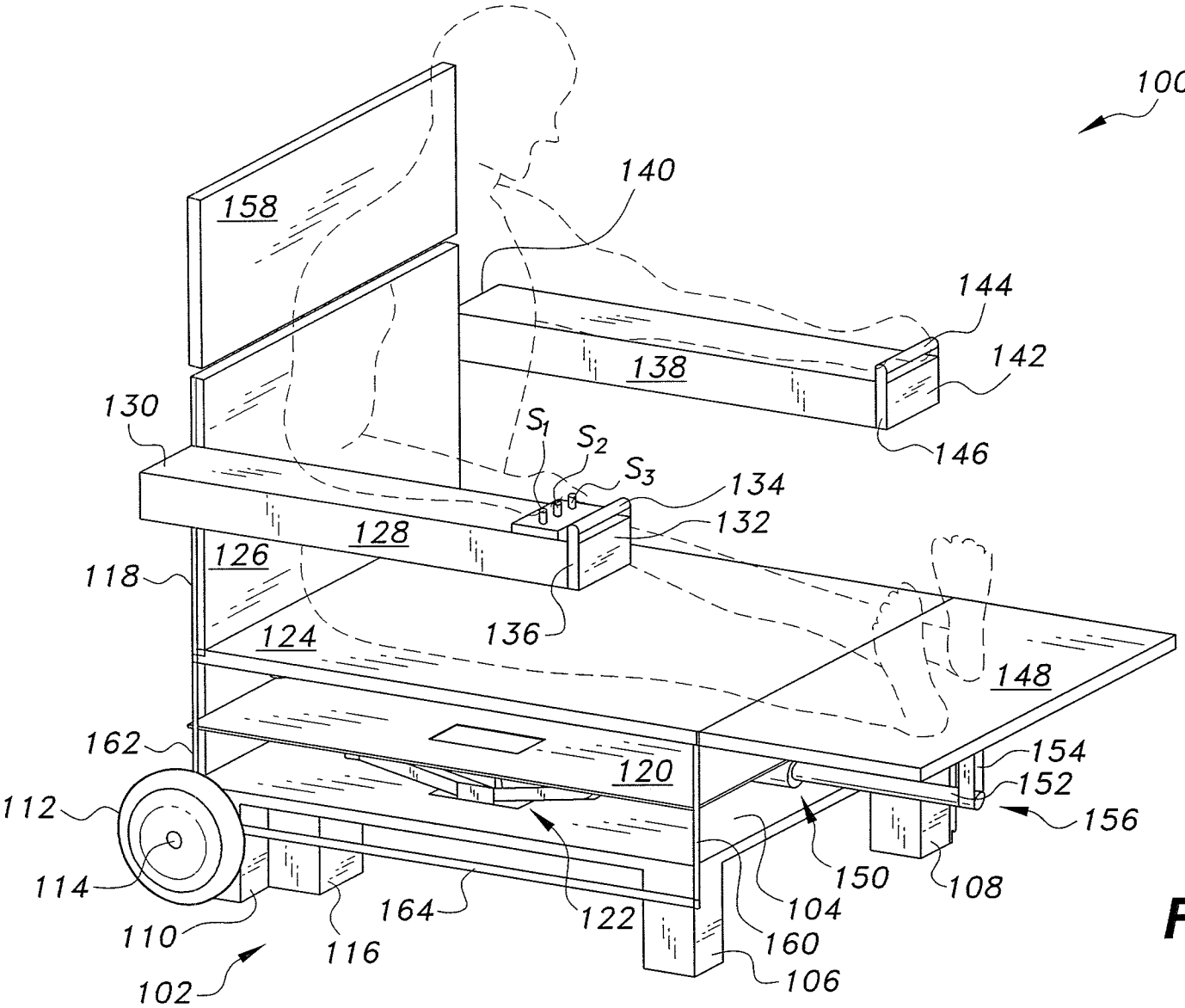
FIG. 1 is an environmental perspective view of a sitting to standing lift chair, showing a user in the chair with the chair in a sitting position.
Figure 2:
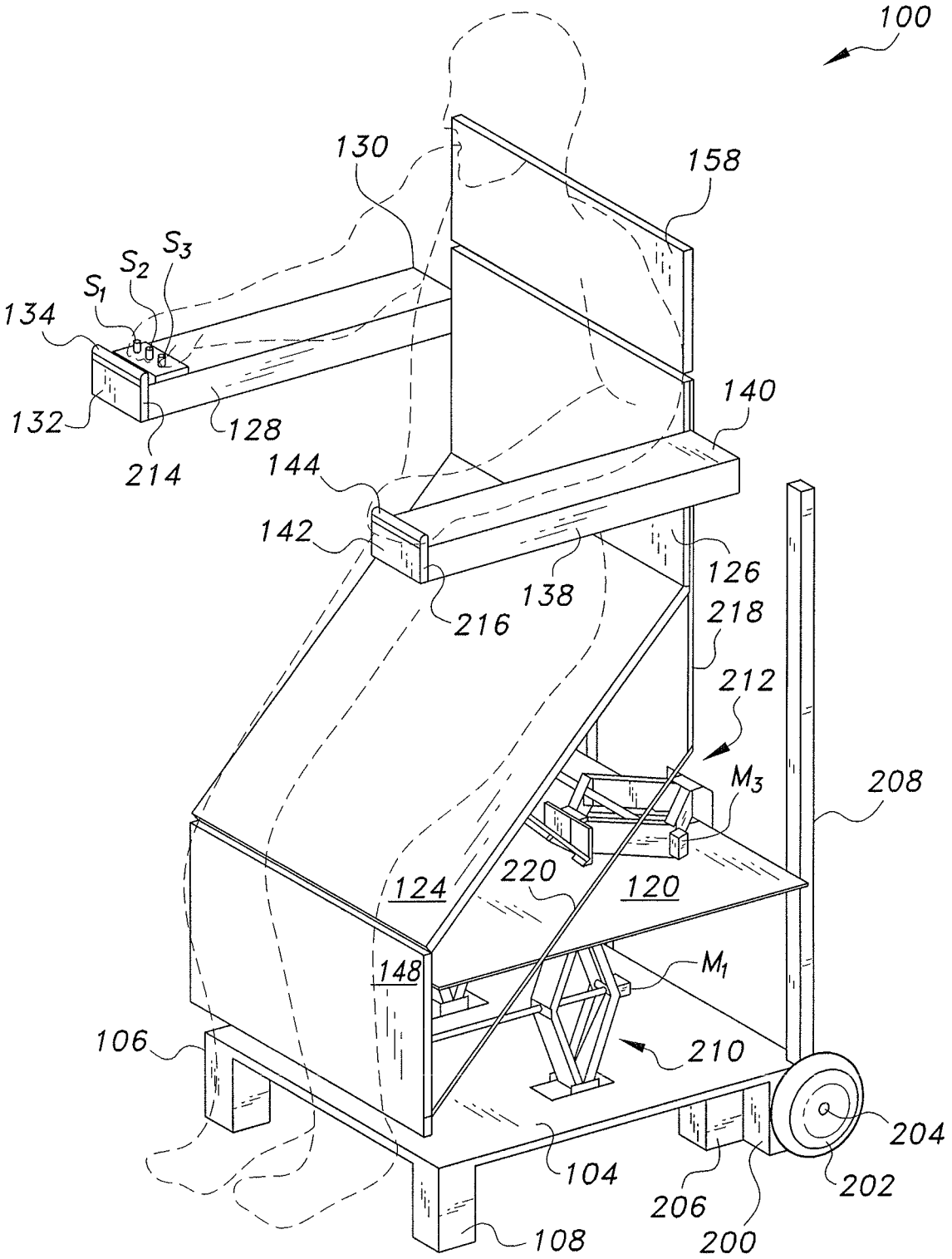
FIG. 2 is an environmental perspective view of the sitting to standing lift chair of FIG. 1, showing the user in the chair in an intermediate position.
Figure 3:
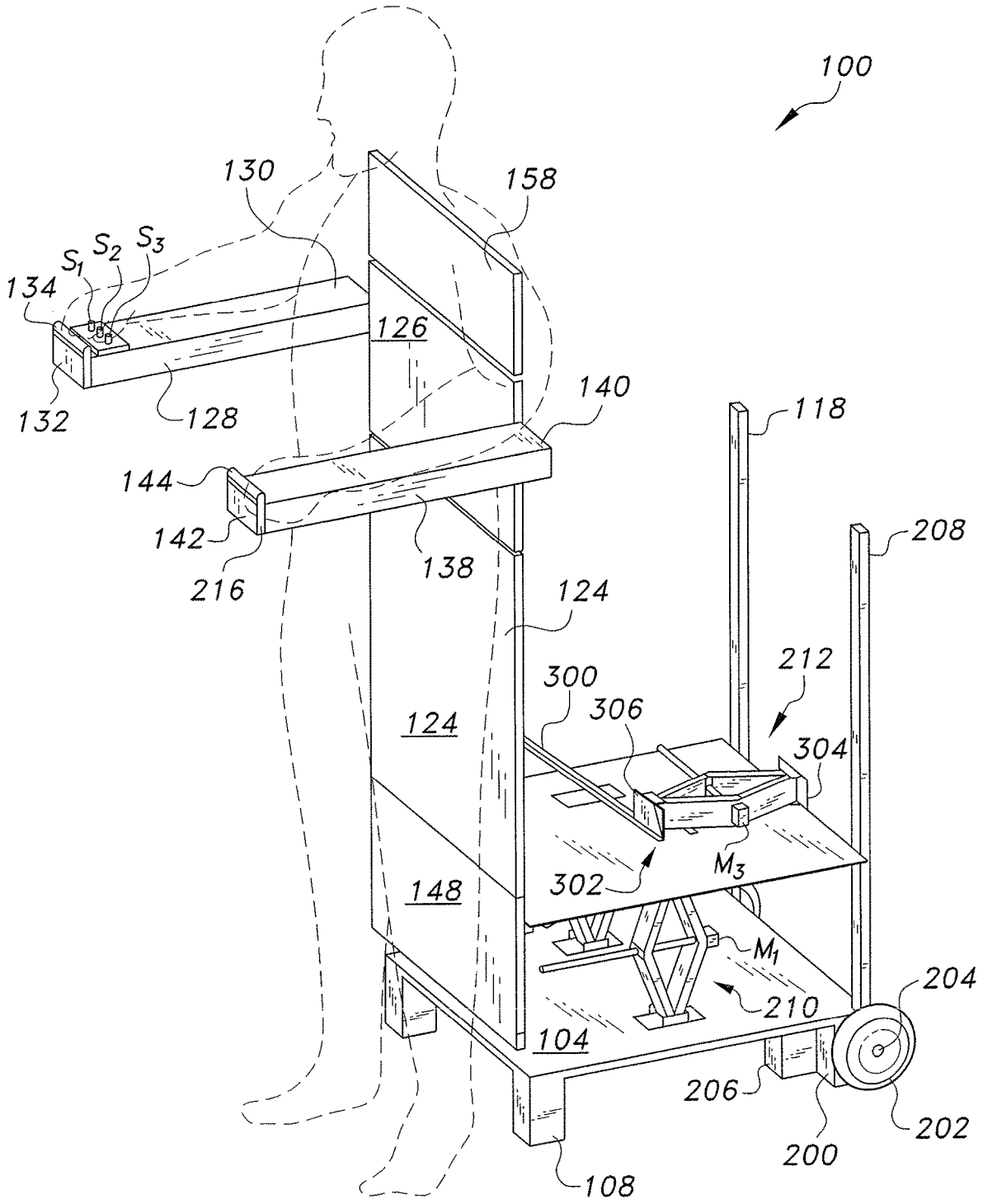
FIG. 3 is an environmental perspective view of the sitting to standing lift chair of FIG. 1, showing the user in a standing position and supported by the chair.
Figure 4:
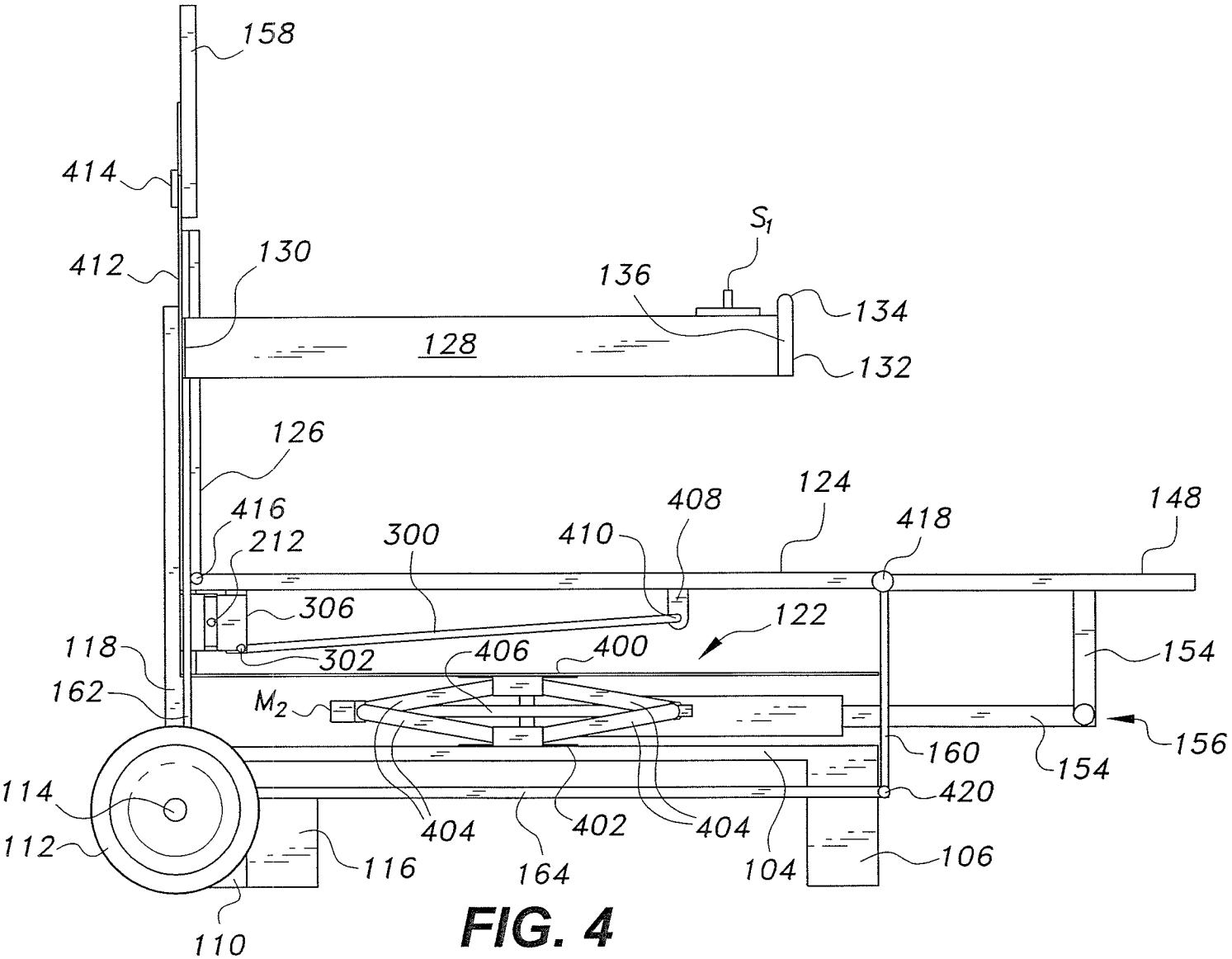
FIG. 4 is a side view of the sitting to standing lift chair of FIG. 1, shown with the chair in the sitting position.
Figure 5:
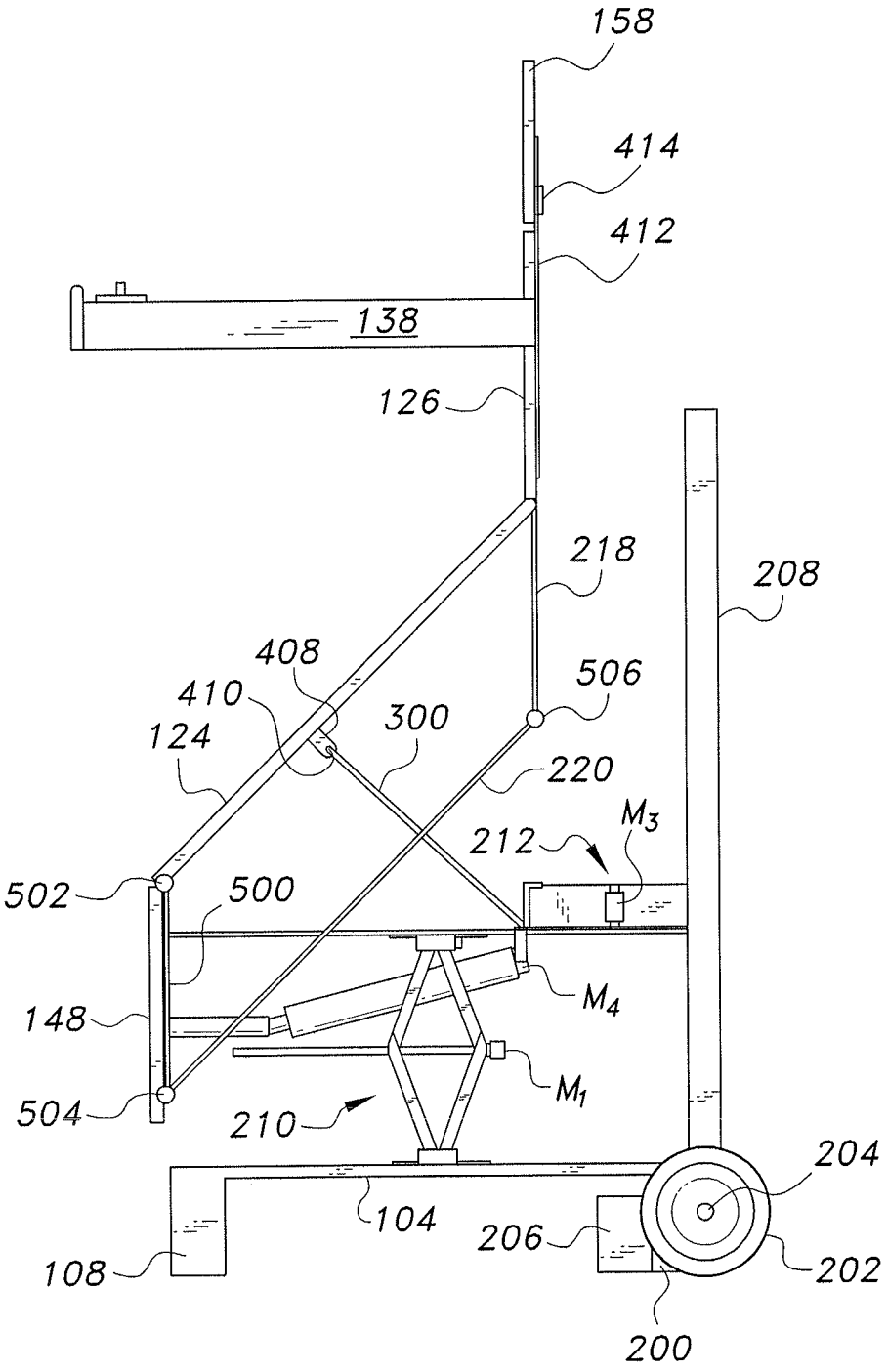
FIG. 5 is a side view of the sitting to standing lift chair of FIG. 1, shown with the chair in an intermediate position.
Figure 6:
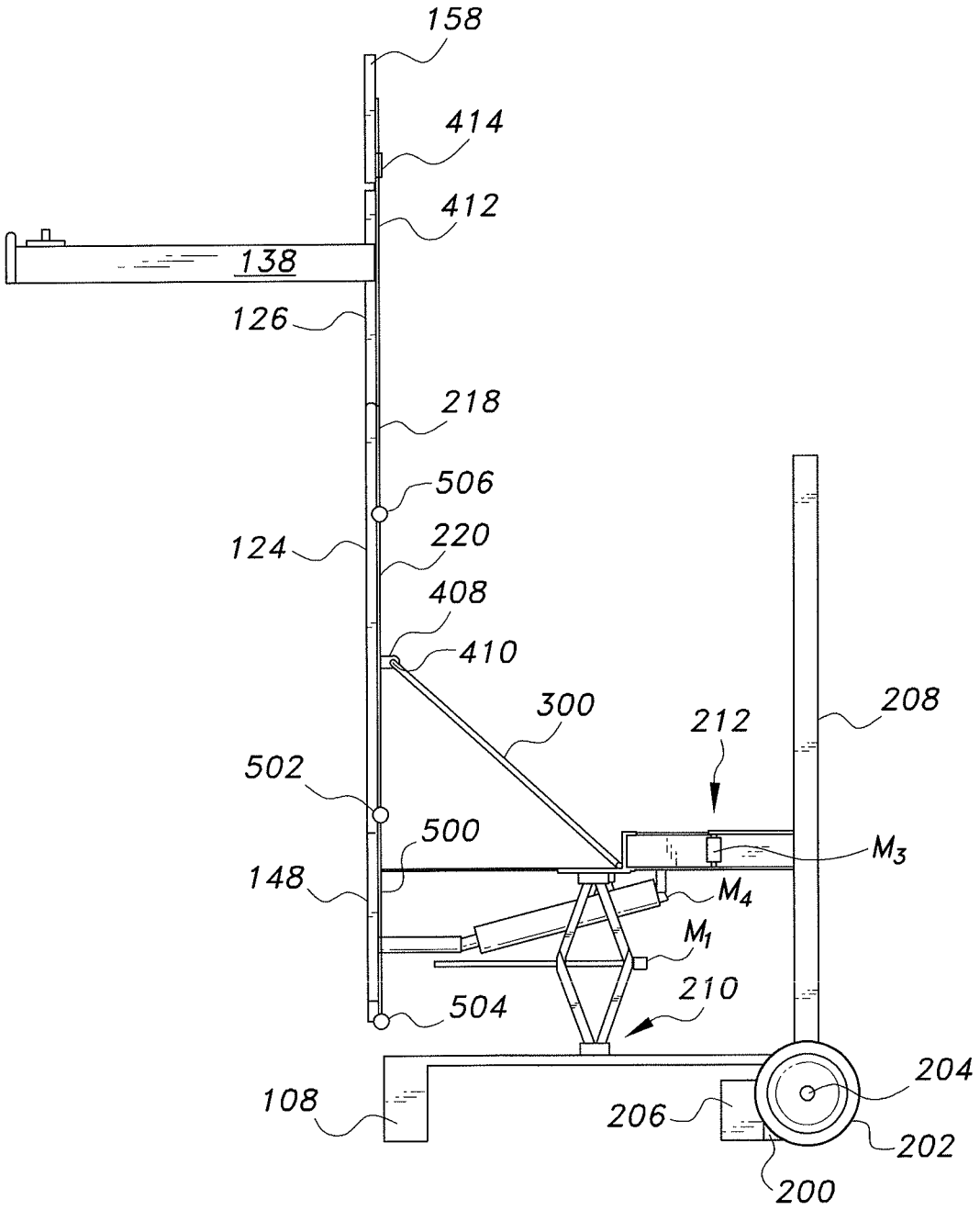
FIG. 6 is a side view of the sitting to standing lift chair of FIG. 1, shown with the chair in the standing position.
Figure 7:
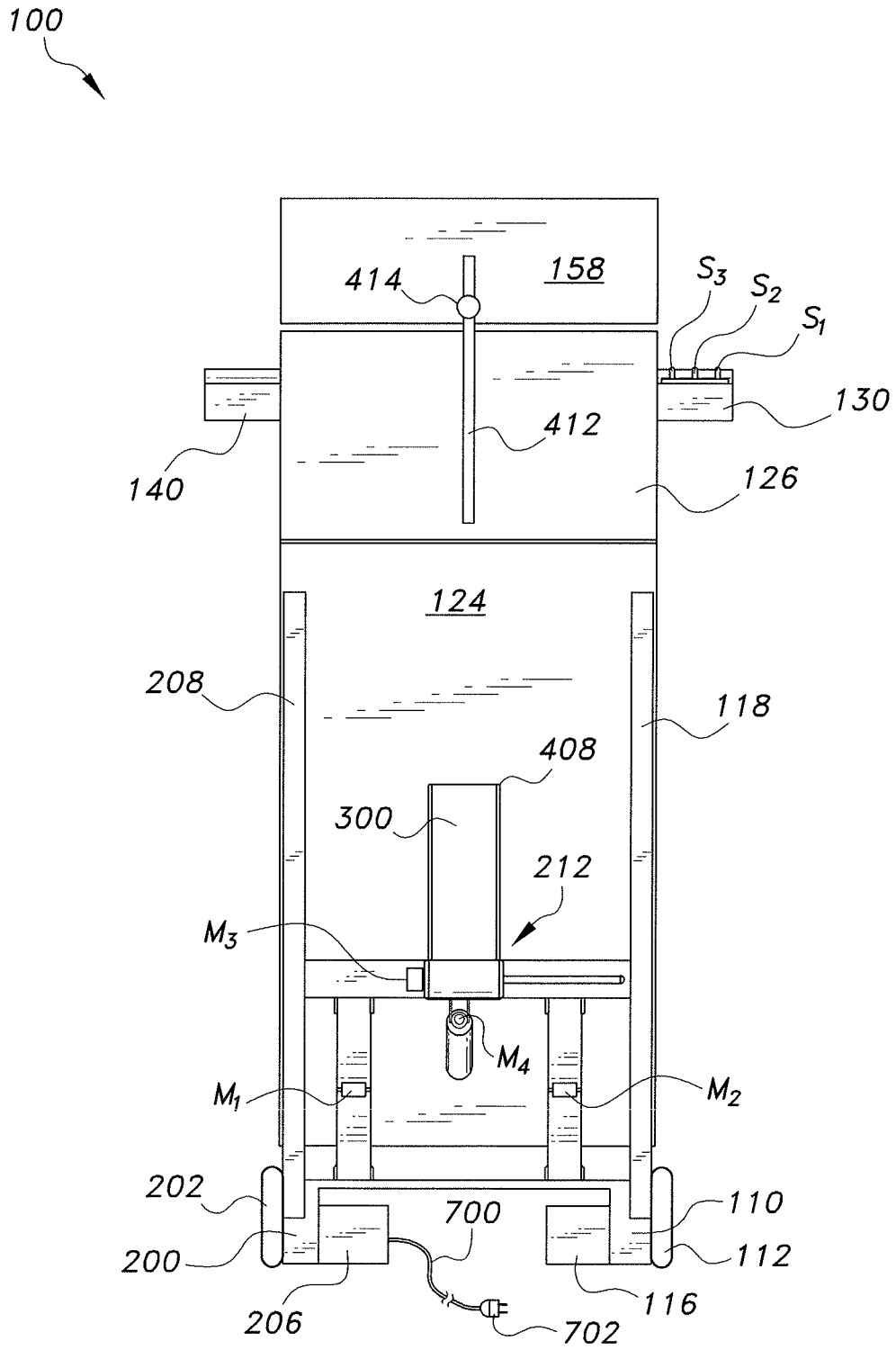
FIG. 7 is a rear view of the sitting to standing lift chair of FIG. 1, shown with the chair in the standing position.

The sitting to standing lift chair 100 is shown in FIGS. 1-7. The chair 100 has a base 102 and a bottom elevated platform 120 that supports the chair's adjustable components. The base includes a base platform 104 that is supported by a right front leg 106, a left front leg 108, a right rear leg 110 and a left rear leg 200. A right wheel 112 is rotatably mounted to the right rear leg 110 on a right wheel axle 114 (see FIG. 1), while a left wheel 202 is rotatably mounted to the left rear leg 200 on a left wheel axle 204 (see FIG. 3). The wheels 112, 202 assist in moving the chair 100, by leaning the unoccupied chair 100 backwards so that the chair 100 is supported on the two wheels 112, 202, and then rolling the chair 100 to the desired position. The base also includes: a relay box 116 adjacent to the right rear leg 110 for housing the relays described below with respect to FIGS. 8-10; and a battery box 206 adjacent to the left rear leg 200 for housing the battery and power supply, as described below with respect to FIG. 11. As shown in FIG. 7, a power cord 700 provides power from electrical plug 702 to the power supply. A right stabilizer rod 118 extends vertically from the right rear edge of the base platform 104, and a left stabilizer rod 208 extends vertically from the left rear edge of the base platform 104. The stabilizer bars 118, 208 help to stabilize the chair 100 when it is in the lowered position, as shown in FIGS. 1 and 4.

The bottom elevated platform 120 is supported on the base platform 104 by an electromechanical chair height adjustment mechanism that includes a right platform scissor lift 122 and a left platform scissor lift 210. The components and operation of the right platform scissor lift 122 will be described with respect to FIG. 4. It should be noted that the left platform scissor lift 210 and a sitting to standing scissor lift 212 (described below) are substantially identical to the right platform scissor lift 122 in terms of construction and operation. As is conventionally known in scissor lift construction, the right platform scissor lift 122 includes an upper platform 400 and a lower platform 402 attached to one another by articulated arms 404. An externally threaded rod 406 extends through threaded holes in end blocks (not shown) attached to the articulated arms 404. In addition to the conventional components, the right platform scissor lift 122 further includes a drive motor $M_2$ for driving the externally threaded rod 406. Similarly, the left platform scissor lift 210 is driven by a left platform lift motor $M_1$. By driving the externally threaded rod 406 in a first direction, the upper platform 400 and the lower platform 402 are driven away from one another, thereby raising the bottom elevated platform 120 relative to the base platform 104. When the externally threaded rod 406 is driven in a second, opposite direction the upper platform 400 and the lower platform 402 are driven toward one another, thereby lowering the bottom elevated platform 120 relative to the base platform 104. The chair height adjustment mechanism allows the bottom elevated platform 120 to be raised and lowered twenty centimeters relative to the base platform 104.

The sitting to standing lift chair 100 further includes a seat bottom 124, a seat back 126 rotatably attached to the rear edge of the seat bottom 124 by a seat back hinge 416, and a footrest 148 rotatably attached to the front edge of the seat bottom 124 by a footrest hinge 418. The seat bottom 124 is supported on the bottom elevated platform 120 using an electromechanical sitting to standing mechanism. The sitting to standing mechanism includes a sitting to standing scissor lift 212, a sitting to standing linkage 300, and a sitting to standing seat bottom linkage 408. The sitting to standing scissor lift 212 includes a sitting to standing scissor lift stationary rear platform 304 rigidly attached to the rear edge of the bottom elevated platform 120 and a sitting to standing scissor lift sliding front platform 306. The sitting to standing linkage 300 is rotatably connected to the sitting to standing scissor lift sliding front platform 306 using a first pivoting sitting to standing linkage connection 302 and is rotatably connected to the sitting to standing seat bottom linkage 408 using a second pivoting sitting to standing linkage connection 410. The sitting to standing seat bottom linkage 408 is rigidly attached to the bottom surface of the seat bottom 124. A sitting to standing motor $M_3$ drives the sitting to standing scissor lift 212. When the sitting to standing scissor lift 212 is in its compact position, as seen in FIG. 4, the sitting to standing lift chair 100 is in the fully seated position parallel to the bottom elevated platform 120. As the sitting to standing motor $M_3$ drives the sitting to standing scissor lift 212, the sitting to standing scissor lift sliding front platform 306 is driven forward of the sitting to standing scissor lift stationary rear platform 304 in a manner similar to that described above with respect to the right platform scissor lift 122. As the sliding front platform 306 moves forward, it presses on the sitting to standing linkage 300, which presses on the sitting to standing seat bottom linkage 408 to thereby raise the seat bottom 124 from the fully seated position (FIGS. 1 and 4) to an intermediate position (FIGS. 2 and 5) and finally to a fully standing position (FIGS. 3, 6 and 7).

To maintain the seat back 126 in its vertical orientation throughout its range of motion (and therefore keep the attached armrests horizontal throughout the same process), the sitting to standing lift chair 100 further includes a right parallelogram mechanism and a left parallelogram mechanism. The right parallelogram mechanism includes a front right parallelogram linkage rod 160, a rear right parallelogram linkage rod 162 and a right parallelogram connecting rod 164. The top end of the front right parallelogram linkage rod 160 is rotatably attached to the bottom surface of the seat bottom 124 proximate to the front right corner of the seat bottom 124. The front right parallelogram linkage rod 160 is rigidly attached to the front right corner of the bottom elevated platform 120 to provide support for the right parallelogram mechanism and the seat bottom 124. As the bottom elevated platform 120 remains in a horizontal orientation, the front right parallelogram linkage rod 160 is held in a vertical orientation. The top end of the rear right parallelogram linkage rod 162 is rigidly attached to the back surface of the seat back 126 proximate to and along the right edge of the seat back 126. The right parallelogram connecting rod 164 is rotatably attached to the bottom end of the front right parallelogram linkage rod 160 and the bottom end of the rear right parallelogram linkage rod 162, such that the seat bottom 124, the rear right parallelogram linkage rod 162, the right parallelogram connecting rod 164 and the vertical front right parallelogram linkage rod 160 form a parallelogram that maintains the seat back 126 in its vertical orientation.

As shown in FIG. 5, the left parallelogram mechanism includes a front left parallelogram linkage rod 500, a rear left parallelogram linkage rod 218 and a left parallelogram connecting rod 220. The top end of the front left parallelogram linkage rod 500 is rotatably attached to the bottom surface of the seat bottom 124 proximate to the front left corner of the seat bottom 124. The front left parallelogram linkage rod 500 is rigidly attached to the front left corner of the bottom elevated platform 120 to provide support for the left parallelogram mechanism and the seat bottom 124. As the bottom elevated platform 120 remains in a horizontal orientation, the front left parallelogram linkage rod 500 is held in a vertical orientation. The top end of the rear left parallelogram linkage rod 218 is rigidly attached to the back surface of the seat back 126 proximate to and along the left edge of the seat back 126. The left parallelogram connecting rod 220 is rotatably attached to the bottom end of the front left parallelogram linkage rod 500 and the bottom end of the rear left parallelogram linkage rod 218, such that the seat bottom 124, the rear left parallelogram linkage rod 218, the left parallelogram connecting rod 220 and the vertical front left parallelogram linkage rod 500 form a parallelogram that maintains the seat back 126 in its vertical orientation.

The footrest 148 is adjusted using an electromechanical footrest positioning mechanism. As shown in FIG. 1, the footrest positioning mechanism includes a linear footrest actuator 150 with an extending rod 152 and a footrest actuator linkage 154 rotatably connected to the end of the extending rod 152 using a pivoting footrest link connection 156. The footrest actuator linkage 154 is rigidly attached to a bottom surface of the footrest 148. A footrest actuator motor $M_4$, drives the linear footrest actuator 150 to extend and retract the extending rod 152 into and out of the body of the linear footrest actuator 150. The extending rod 152 may be externally threaded and the linear footrest actuator 150 may include an internally threaded drive nut (not shown) that is driven by the footrest actuator motor $M_4$, to thereby drive the externally threaded extending rod 152 into and out of the body of the linear footrest actuator 150. In the fully retracted position of the extending rod 152, the footrest 148 is relatively vertical, as shown in FIGS. 2, 3 and 5-7. In the fully extended position of the extending rod 152, the footrest 148 is relatively horizontal as shown in FIGS. 1 and 4. Of course the footrest 148 can be adjusted to a number of positions between vertical and horizontal.

The sitting to standing lift chair 100 further includes a right armrest 128 and a left armrest 138. The right armrest 128 has a proximal end 130 that is attached to the right edge of the seat back 126 and a distal end 132 having a right handgrip 134. The right handgrip 134 is attached to the distal end 132 of the right armrest 128 using an outer right handgrip bracket 136 and an inner right handgrip bracket 214, such that the right handgrip 134 is above the top surface of the distal end 132 of the right armrest 128 to allow the patient to grip the right handgrip 134 with their right hand. The left armrest 138 has a proximal end 140 that is attached to the left edge of the seat back 126 and a distal end 142 having a left handgrip 144. The left handgrip 144 is attached to the distal end 142 of the left armrest 138 using an outer left handgrip bracket 136 and an inner left handgrip bracket 146, such that the left handgrip 144 is above the top surface of the distal end 142 of the left armrest 138 to allow the patient to grip the left handgrip 144 with their left hand. The handgrips 134, 144 are covered with a non-slip material to provide a firm gripping surface. The distal end 132 of the right armrest 128 also includes three lift chair control switches $S_1$-$S_3$. The lift chair control switches $S_1$-$S_3$ are spring-loaded switches that can be pressed forward or rearward and return to the central neutral position (as shown in the figures) when released. The lift chair control switches $S_1$-S3 are used to control various functions of the sitting to standing lift chair 100, as described below. It should be understood that the lift chair control switches $S_1$-$S_3$ can be placed on the distal end of either armrest, or in any area on the device that is deemed to be most accessible to the particular user, depending on their physical abilities.

The sitting to standing lift chair 100 may also include a headrest 158 that is attached to the top of the seat back 126 using a headrest adjustment mechanism. As shown in FIG. 4, the headrest adjustment mechanism includes a headrest support bar 412 that is rigidly attached to the center top of the back surface of the seat back 126. A headrest adjustment knob 414 includes an externally threaded rod that extends through a central slot in the headrest support bar 412 and into an internally threaded blind bore in the back surface of the headrest 158. Alternatively, the headrest support bar 412 may be rigidly attached to the back surface of the headrest 158 and the headrest adjustment knob 414 may extend through a central slot in the headrest support bar 412 and into an internally threaded blind bore in the back surface of the seat back 126. To adjust the height of the headrest 158, the headrest adjustment knob 414 is loosened and the headrest 158 is manually moved to the desired height. The headrest adjustment knob 414 is then tightened to maintain the position of the headrest 158 relative to the seat back 126. The adjustable headrest provides a chair back height of between forty-six centimeters to fifty-six centimeters.

The portions of the sitting to standing lift chair 100 that are contacted by the user are covered with a comfortable material, and the seat bottom 124, the seat back 126, the footrest 148 and the headrest 158 can also be covered by a body-contouring sponge that allows for a smooth and comfortable exterior shape, which supports the user. To provide safety of the user, the electromechanical components (linear footrest actuator 150 and scissor lifts 122, 210, 212) are placed out of the way, so that loose material or clothing will not get caught or wound around these components. These components may further be sealed or covered with smooth material in order to prevent any accidental pinching, snagging, or scratching, as well as to protect the component from dust or water. The electromechanical components also offer fail-safe use, such that if the motors $M_1$-$M_4$ fail to operate for any reason, the device will stop in place without any fear of collapsing or being back-driven by the user's weight. All electrical wiring and components are kept out of reach of the user, except the control switches $S_1$-$S_3$, which are easily accessed by the user. The physical safety of the user is also guaranteed by providing correct posture throughout motion. The user can find support in the different components of the device, such as the armrests, handgrips, footrest, and the seatback, which remains vertical during the sitting to standing or standing to sitting processes.

Figure 8:
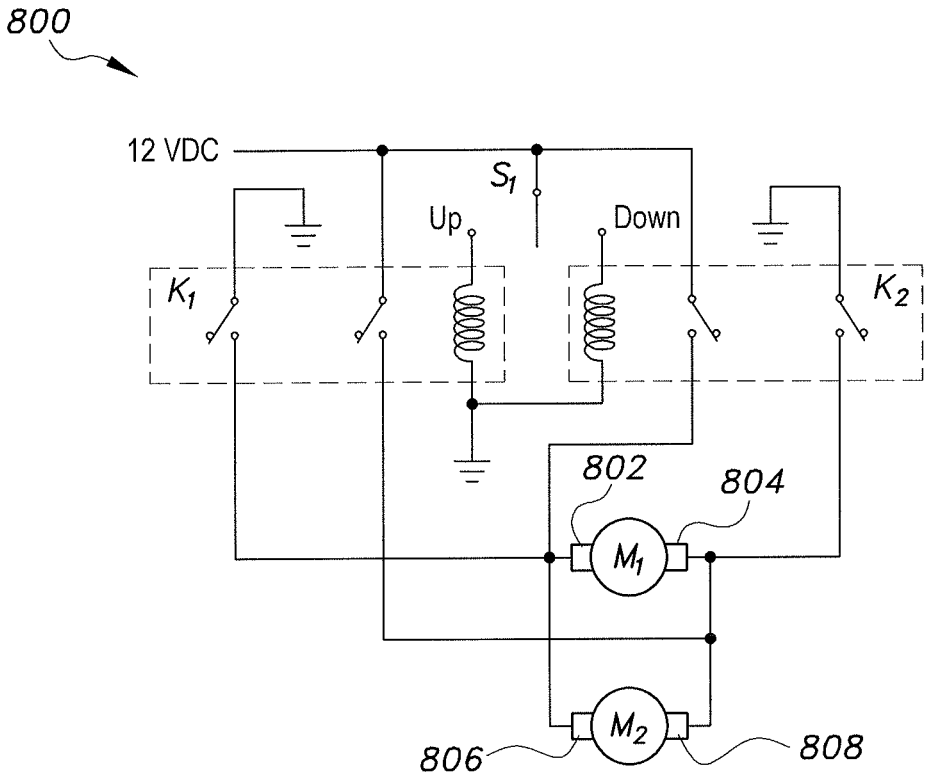
FIG. 8 is a schematic diagram of an exemplary chair height electrical control circuit of the sitting to standing lift chair of FIG. 1.

A schematic diagram of an electrical control circuit 800 for the chair height adjustment mechanism is shown in FIG. 8. The chair height control switch $S_1$ is a single pole, double throw (SPDT) switch with three terminals; including one input terminal (pole) and two output terminals (throws). Sometimes this type of switch is known as a selector switch. The input terminal is connected to a 12 VDC supply. The Up output terminal is connected to the coil of up relay $K_1$, while the Down output terminal is connected to the coil of down relay $K_2$. When a patient presses the switch $S_1$ rearward, the input terminal is connected to the Up output terminal and up relay $K_1$ is energized. When up relay $K_1$ is energized, ground is connected to terminal 802 of left platform lift motor $M_1$ and terminal 806 of right platform lift motor $M_2$ and 12 VDC is connected to terminal 804 of left platform lift motor $M_1$ and terminal 808 of right platform lift motor $M_2$, thereby causing the motors $M_1$,$M_2$ to drive the right platform scissor lift 122 and the left platform scissor lift 210 in a first direction such that the bottom elevated platform 120 is raised upward relative to the base platform 104. When a patient presses the switch $S_1$ forward, the input terminal is connected to the Down output terminal and down relay $K_2$ is energized. When down relay $K_2$ is energized, 12 VDC is connected to terminal 802 of left platform lift motor $M_1$ and terminal 806 of right platform lift motor $M_2$ and ground is connected to terminal 804 of left platform lift motor $M_1$ and terminal 808 of right platform lift motor $M_2$, thereby causing the motors $M_1$,$M_2$ to drive the right platform scissor lift 122 and the left platform scissor lift 210 in a second direction such that the bottom elevated platform 120 is lowered toward the base platform 104.

Figure 9:
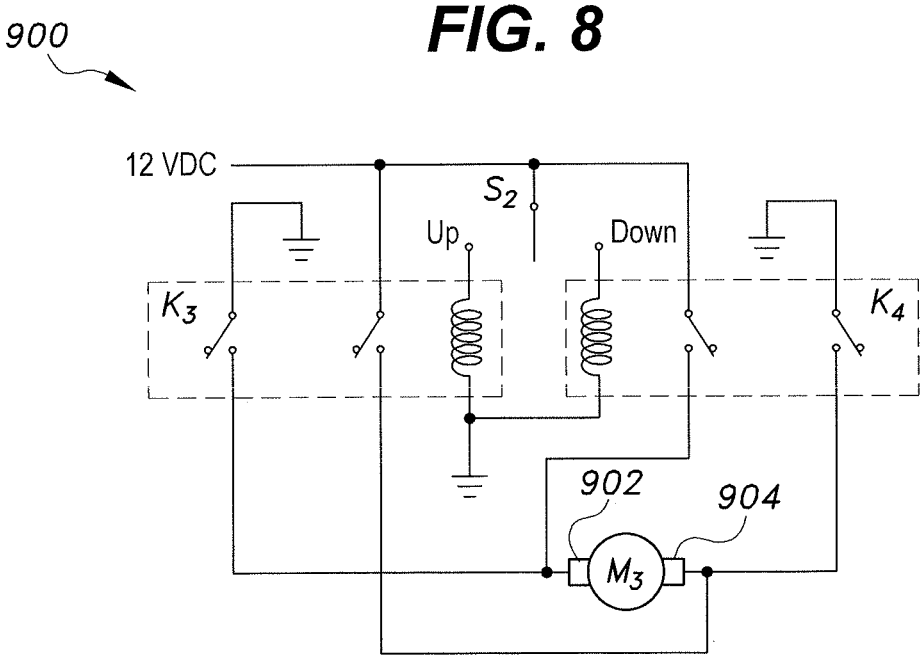
FIG. 9 is a schematic diagram of an exemplary sitting/standing electrical control circuit of the sitting to standing lift chair of FIG. 1.

A schematic diagram of an electrical control circuit 900 for the sitting/standing adjustment mechanism is shown in FIG. 9. As with the chair height control switch $S_1$, the sitting/standing control switch $S_2$ is a single pole, double throw (SPDT) switch with three terminals; including one input terminal and two output terminals. The input terminal is connected to a 12 VDC supply. The Up output terminal is connected to the coil of up relay $K_3$, while the Down output terminal is connected to the coil of down relay $K_4$. When a patient presses the sitting/standing control switch $S_2$ rearward, the input terminal is connected to the Up output terminal and up relay $K_3$ is energized. When up relay $K_3$ is energized, ground is connected to terminal 902 of the sitting to standing motor $M_3$ and 12 VDC is connected to terminal 904 of the sitting to standing motor $M_3$, thereby causing the sitting to standing motor $M_3$ to drive the sitting to standing scissor lift 212 in a first direction such that the seat bottom 124 is raised and rotated toward the standing position. When a patient presses the sitting/standing control switch $S_2$ forward, the input terminal is connected to the Down output terminal and down relay $K_4$ is energized. When down relay $K_4$ is energized, 12 VDC is connected to terminal 902 of the sitting to standing motor $M_3$ and ground is connected to terminal 904 of motor $M_3$, thereby causing the motor $M_3$, to drive the sitting to standing scissor lift 212 in a second direction such that the seat bottom 124 is lowered and rotated toward the sitting position.

Figure 10:
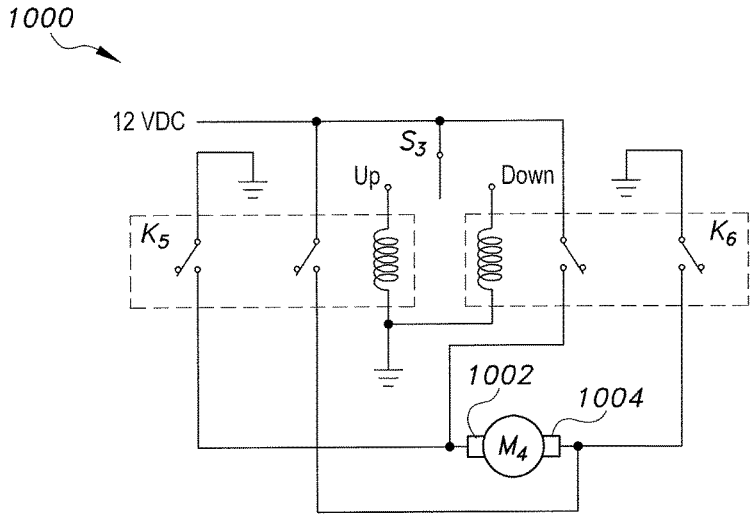
FIG. 10 is a schematic diagram of an exemplary footrest electrical control circuit of the sitting to standing lift chair of FIG. 1.

A schematic diagram of an electrical control circuit 1000 for the footrest adjustment mechanism is shown in FIG. 10. As with the chair height control switch $S_1$, the footrest adjustment control switch $S_3$ is a single pole, double throw (SPDT) switch with three terminals; including one input terminal and two output terminals. The input terminal is connected to a 12 VDC supply. The Up output terminal is connected to the coil of up relay $K_5$, while the Down output terminal is connected to the coil of down relay $K_6$. When a patient presses the footrest adjustment control switch $S_3$ rearward, the input terminal is connected to the Up output terminal and up relay $K_5$ is energized. When up relay $K_5$ is energized, ground is connected to terminal 1002 of the footrest actuator motor $M_4$ and 12 VDC is connected to terminal 1004 of the footrest actuator motor $M_4$, thereby causing the footrest actuator motor $M_4$ to drive the extending rod 152 out of the body of the linear footrest actuator 150, such that the footrest 148 is raised toward the horizontal position. When a patient presses the footrest adjustment control switch $S_3$ forward, the input terminal is connected to the Down output terminal and down relay $K_6$ is energized. When down relay $K_6$ is energized, 12 VDC is connected to terminal 1002 of the footrest actuator motor $M_4$ and ground is connected to terminal 1004 of the footrest actuator motor $M_4$, thereby causing the footrest actuator motor $M_4$ to drive the extending rod 152 into the body of the linear footrest actuator 150, such that the footrest 148 is lowered toward the vertical position.

It should be understood that the operation of the lift chair control switches $S_1$-$S_3$, wherein rearward movement activates the Up relays and forward movement activates the Down relays, can be reversed (rewired) for one, two or all three switches, as desired by the user (patient).

Figure 11:
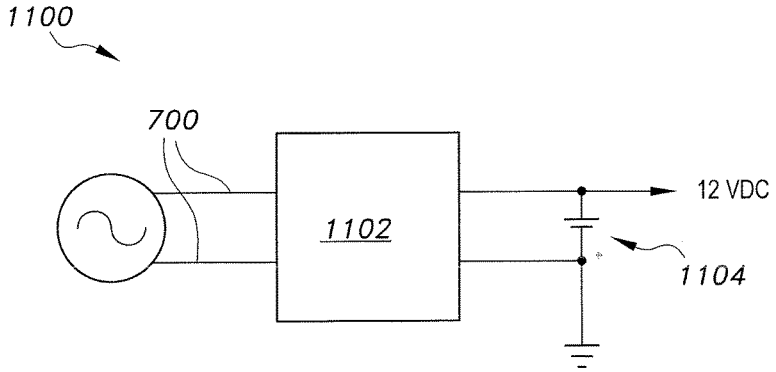
FIG. 11 is a schematic diagram of an exemplary power supply circuit of the sitting to standing lift chair of FIG. 1.

A schematic diagram of a power supply circuit 1100 of the sitting to standing lift chair 100 is shown in FIG. 11. Electrical power is provided via power cord 700 which is shown as a two conductor power cord, although a third conductor may be provided for grounding the electrically conductive components of the chair 100, if desired or required for compliance with any local regulations or laws. An AC to DC power supply 1102 converts the AC input voltage (120 or 240) to 12 VDC. The output of the power supply 1102 is connected to a rechargeable battery 1104, as well as to control circuits 800, 900, 1000. The rechargeable battery 1104 provides power for the various functions of the chair 100 when a power outlet is not available or during power outages.

It is to be understood that the sitting to standing lift chair is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A sitting to standing lift chair, comprising:

a base having a base platform;

a bottom elevated platform, the bottom elevated platform having a bottom surface, a top surface, a front edge, and a rear edge;

an electromechanical chair height adjustment mechanism supporting the bottom elevated platform on the base platform a seat bottom, the seat bottom having a bottom surface, a top surface, a front edge, and a rear edge;

an electromechanical sitting to standing mechanism supporting the seat bottom on the bottom elevated platform;

a seat back and a seat back hinge rotatably attaching the seat back to the rear edge of the seat bottom, the seat back having a bottom edge, a top edge, a right edge, a left edge, a front surface, and a rear surface;

a first chair height adjustment switch electrically connected to the electromechanical chair height adjustment mechanism for actuating the chair height adjustment mechanism, the first switch having a neutral position, an up position activating the electromechanical chair height adjustment mechanism to raise the bottom elevated platform relative to the base platform, and a down position activating the electromechanical chair height adjustment mechanism to lower the bottom elevated platform relative to the base platform; and a second sitting to standing switch electrically connected to the electromechanical sitting to standing mechanism for actuating the sitting to standing mechanism, the second switch having a neutral position, an up position actuating the electromechanical sitting to standing mechanism to raise and rotate the seat bottom relative to the elevated platform and to raise the seat back relative to the elevated platform toward a standing position of the sitting to standing lift chair, and a down position actuating the electromechanical sitting to standing mechanism to lower and rotate the seat bottom relative to the elevated platform and to lower the seat back relative to the elevated platform toward a seating position of the sitting to standing lift chair.

2. The sitting to standing lift chair according to claim 1, further comprising a footrest and a footrest hinge rotatably attaching the footrest to the front edge of the seat bottom.

3. The sitting to standing lift chair as recited in claim 2, further comprising:

a footrest positioning mechanism connected to the footrest; and a third footrest adjustment control switch for activating the footrest positioning mechanism, the third switch having a neutral position, an up position activating the footrest positioning mechanism to raise the footrest toward a horizontal position, and a down position activating the footrest positioning mechanism to lower the footrest toward a vertical position.

4. The sitting to standing lift chair as recited in claim 3, wherein the footrest positioning mechanism comprises:

a linear actuator having a body attached to the bottom surface of the bottom elevated platform and an extending rod adjustably extending out of the actuator body and having a distal end;

a footrest actuator linkage having a first end rotatably connected to the distal end of the extending rod and a second end rigidly attached to a bottom surface of the footrest; and a footrest actuator motor driving the linear actuator to extend and retract the extending rod into and out of the body of the linear footrest actuator, the footrest actuator motor being electrically connected to the third footrest adjustment control switch.

5. The sitting to standing lift chair as recited in claim 1, further comprising:

a right armrest having a proximal end attached to the right edge of the seat back and a distal end; and a left armrest having a proximal end attached to the left edge of the seat back and a distal end.

6. The sitting to standing lift chair as recited in claim 5, further comprising:

a right handgrip, an outer right handgrip bracket, and an inner right handgrip bracket, the right handgrip brackets attaching the right handgrip to the distal end of the right armrest such that the right handgrip is above a top surface of the distal end of the right armrest; and a left handgrip, an outer left handgrip bracket, and an inner left handgrip bracket, the left handgrip brackets attaching the left handgrip to the distal end of the left armrest such that the left handgrip is above a top surface of the distal end of the left armrest.

7. The sitting to standing lift chair as recited in claim 6, wherein the first switch and the second switch are mounted on the top surface of the distal end of the right armrest.

8. The sitting to standing lift chair as recited in claim 1, further comprising:

a right parallelogram mechanism attached to the seat back; and a left parallelogram mechanism attached to the seat back, the right parallelogram mechanism and the left parallelogram mechanism maintaining the seat back in a vertical orientation in its seating position, its standing position and positions in between its seating position and its standing position.

9. The sitting to standing lift chair as recited in claim 8, wherein:

the right parallelogram mechanism comprises:

a front right parallelogram linkage rod having a top end rotatably attached to the bottom surface of the seat bottom proximate to a front right corner of the seat bottom, and having a bottom end, the front right parallelogram linkage rod being rigidly attached in a vertical orientation to a front right corner of the bottom elevated platform;

a rear right parallelogram linkage rod having a top end rigidly attached to the back surface of the seat back proximate to and along the right edge of the seat back, the rear right parallelogram linkage rod having a bottom end; and a right parallelogram connecting rod having a first end rotatably attached to the bottom end of the front right parallelogram linkage rod and a second end rotatably attached to the bottom end of the rear right parallelogram linkage rod; and the left parallelogram mechanism comprises:

a front left parallelogram linkage rod having a top end rotatably attached to the bottom surface of the seat bottom proximate to a front left corner of the seat bottom, and having a bottom end, the front left parallelogram linkage rod being rigidly attached in a vertical orientation to a front left corner of the bottom elevated platform;

a rear left parallelogram linkage rod having a top end rigidly attached to the back surface of the seat back proximate to and along the left edge of the seat back, the rear left parallelogram linkage rod having a bottom end; and a left parallelogram connecting rod having a first end rotatably attached to the bottom end of the front left parallelogram linkage rod and a second end rotatably attached to the bottom end of the rear left parallelogram linkage rod.

10. The sitting to standing lift chair as recited in claim 1, wherein the base further comprises a plurality of legs depending therefrom for supporting the base platform.

11. The sitting to standing lift chair as recited in claim 10, wherein the plurality of legs comprises:

a right front leg;

a left front leg;

a right rear leg; and a left rear leg.

12. The sitting to standing lift chair as recited in claim 11, wherein the base further comprises;

a right wheel and a right wheel axle, the right wheel axle being mounted to the right rear leg of the base, the right wheel being rotatably mounted on the right wheel axle; and a left wheel and a left wheel axle, the left wheel axle being mounted to the left rear leg of the base, the left wheel being rotatably mounted on the left wheel axle.

13. The sitting to standing lift chair as recited in claim 11, further comprising:

a relay box adjacent to the right rear leg of the base; and a battery box adjacent to the left rear leg of the base.

14. The sitting to standing lift chair as recited in claim 13, further comprising a rechargeable battery housed in the battery box, the rechargeable battery being connected to the first chair height adjustment switch for powering the electromechanical chair height adjustment mechanism and being connected to the second sitting to standing switch for powering the electromechanical sitting to standing mechanism.

15. The sitting to standing lift chair as recited in claim 14, further comprising an AC to DC power supply housed in the battery box further houses an AC to DC power supply for converting an AC input voltage to a DC output voltage, the AC to DC power supply being connected to the rechargeable battery for recharging the battery, the AC to DC power supply being connected to the first chair height adjustment switch for supplying power to the electromechanical chair height adjustment mechanism and connected to the first chair height adjustment switch for supplying power to the electromechanical sitting to standing mechanism.

16. The sitting to standing lift chair as recited in claim 1, wherein the base further comprises:

a right stabilizer rod extending vertically from a right rear edge of the base platform; and a left stabilizer rod extending vertically from a left rear edge of the base platform.

17. The sitting to standing lift chair as recited in claim 1, wherein the electromechanical chair height adjustment mechanism comprises:

a right platform scissor lift having:

a first upper platform contacting the bottom surface of the seat bottom;

a first lower platform supported on the top surface of the bottom elevated platform;

a first plurality of articulated arms connecting the first upper platform to the first lower platform;

a first externally threaded rod connected to the first plurality of articulated arms to extend and retract the articulated arms to control separation between the first upper platform and the first lower platform; and a right platform scissor lift drive motor driving the first externally threaded rod to control separation between the first upper platform and the first lower platform; and a left platform scissor lift comprising:

a second upper platform contacting the bottom surface of the seat bottom;

a second lower platform supported on the top surface of the bottom elevated platform;

a second plurality of articulated arms connecting the second upper platform to the second lower platform;

a second externally threaded rod connected to the second plurality of articulated arms to extend and retract the articulated arms to control separation between the second upper platform and the second lower platform; and a left platform scissor lift drive motor driving the second externally threaded rod to control separation between the second upper platform and the second lower platform.

18. The sitting to standing lift chair as recited in claim 1, wherein the electromechanical sitting to standing mechanism comprises:

a sitting to standing scissor lift having:

a sitting to standing scissor lift stationary rear platform rigidly attached to the rear edge of the bottom elevated platform;

a sitting to standing scissor lift sliding front platform;

a third plurality of articulated arms connecting the sitting to standing scissor lift stationary rear platform to the sitting to standing scissor lift sliding front platform;

a third externally threaded rod connected to the third plurality of articulated arms to extend and retract the articulated arms to control separation between the stationary rear platform and the sliding front platform; and a sitting to standing motor driving the third externally threaded rod to control separation between the stationary rear platform and the sliding front platform;

a sitting to standing seat bottom linkage having a first end rigidly attached to the bottom surface of the seat bottom and having a second end; and a sitting to standing linkage rotatably connected to the sitting to standing scissor lift sliding front platform and rotatably attached to the second end of the sitting to standing seat bottom linkage.

19. The sitting to standing lift chair as recited in claim 1, wherein:

the electromechanical chair height adjustment mechanism comprises:

a right platform scissor lift having:

a first upper platform contacting the bottom surface of the seat bottom;

a first lower platform supported on the top surface of the bottom elevated platform;

a first plurality of articulated arms connecting the first upper platform to the first lower platform;

a first externally threaded rod connected to the first plurality of articulated arms to extend and retract the articulated arms to control separation between the first upper platform and the first lower platform; and a right platform scissor lift drive motor driving the first externally threaded rod to control separation between the first upper platform and the first lower platform; and a left platform scissor lift comprising:

a second upper platform contacting the bottom surface of the seat bottom;

a second lower platform supported on the top surface of the bottom elevated platform;

a second plurality of articulated arms connecting the second upper platform to the second lower platform;

a second externally threaded rod connected to the second plurality of articulated arms to extend and retract the articulated arms to control separation between the second upper platform and the second lower platform; and a left platform scissor lift drive motor driving the second externally threaded rod to control separation between the second upper platform and the second lower platform; and the electromechanical sitting to standing mechanism comprises:

a sitting to standing scissor lift having:

a sitting to standing scissor lift stationary rear platform rigidly attached to the rear edge of the bottom elevated platform;

a sitting to standing scissor lift sliding front platform;

a third plurality of articulated arms connecting the sitting to standing scissor lift stationary rear platform to the sitting to standing scissor lift sliding front platform;

a third externally threaded rod connected to the third plurality of articulated arms to extend and retract the articulated arms to control separation between the stationary rear platform and the sliding front platform; and a sitting to standing motor driving the third externally threaded rod to control separation between the stationary rear platform and the sliding front platform;

a sitting to standing seat bottom linkage having a first end rigidly attached to the bottom surface of the seat bottom and having a second end; and a sitting to standing linkage rotatably connected to the sitting to standing scissor lift sliding front platform and rotatably attached to the second end of the sitting to standing seat bottom linkage.

20. The sitting to standing lift chair as recited in claim 1, further comprising:

a headrest attached to the top edge of the seat back, the headrest having a back surface; and a headrest adjustment mechanism having:

a headrest support bar having a central slot defined therein, the headrest support bar being rigidly attached to a support surface selected from the group consisting of the back surface of the seat back and the back surface of the headrest, the support surface having an internally threaded blind bore defined therein; and a headrest adjustment knob having an externally threaded rod extending through the central slot in the headrest support bar and into the internally threaded blind bore defined in the support surface.

* * * * *